US006830081B1

(12) United States Patent
Chen

(10) Patent No.: US 6,830,081 B1
(45) Date of Patent: Dec. 14, 2004

(54) HIGH EFFICIENCY VACUUM BOX WITH INDICATORS

(76) Inventor: Fu-Lung Su Chen, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/601,293

(22) Filed: Jun. 23, 2003

(51) Int. Cl.[7] ..... B65B 1/04
(52) U.S. Cl. ..... 141/65; 141/95; 220/203.19
(58) Field of Search ..... 141/65, 95; 220/203.01, 220/203, 212; 215/228, 311; 417/437

(56) References Cited

U.S. PATENT DOCUMENTS 5,564,480 A * 10/1996 Chen ..... 141/65
5,806,575 A * 9/1998 Tsay ..... 141/65
6,662,831 B2 * 12/2003 Chen ..... 141/65

* cited by examiner

*Primary Examiner*—Steven O. Douglas

(57) ABSTRACT

A vacuum box comprises a lower box; an upper cover; an isolating layer; a pump unit; a motor; a battery; a control button. The isolating layer is installed with a pressure display unit. The pressure display unit is formed by a pressure button installed in a pressure hole of the isolating layer by an airtight ring, and a spring below the pressure button. A sealed airbag installed at a top cover of the pressure button and a periphery of the spring; and a display mask connected to the pressure button. The display mask is pivotally installed to ears of the isolating layer; a top of the display mask is mounted with at least two color indicators. The pressure button is installed with a sensing switch which sense the rising or descending of the pressure button.

10 Claims, 6 Drawing Sheets

HIGH EFFICIENCY VACUUM BOX WITH INDICATORS

FIELD OF THE INVENTION

The present invention relates to vacuum boxes, and particularly to a vacuum box with an indicator and an effective pumping system so as to retain the vacuum level of the box.

BACKGROUND OF THE INVENTION

In the prior art vacuum box, the vacuum is retained manually and the vacuum level of the box can not be viewed in advance. The vacuum pump is actuated manually, but it can not stop automatically so that it is often that the vacuum level in the box is too low so as to deform the box. Thereby, the user must stop the motor manually and thus the user must take care of the vacuum level of the box. Moreover, users can not know the pressure and conditions of the box so that the vacuum level can not monitor by the user. This induce inconvenience to the users.

SUMMARY OF THE INVENTION

Accordingly, the primary object of the present invention is to provide a vacuum box which comprises a lower box; an upper cover; an isolating layer; a pump unit; a motor; a battery set; a control button. The isolating layer is installed with a pressure display unit. The pressure display unit is formed by a pressure button installed in a pressure hole of the isolating layer by an airtight ring, a spring below the pressure button. A sealed airbag installed at a top cover of the pressure button and a periphery of the spring; and a display mask connected to the pressure button. The display mask is pivotally installed to ears of the isolating layer; a top of the display mask is mounted with at least two color indicators. The pressure button is installed with A sensing switch which senses the rising or descending of the pressure button.

The various objects and advantages of the present invention will be more readily understood from the following detailed description when read in conjunction with the appended drawing.

DETAILED DESCRIPTION OF THE PREFERRED EMBODIMENTS

Figure 1:
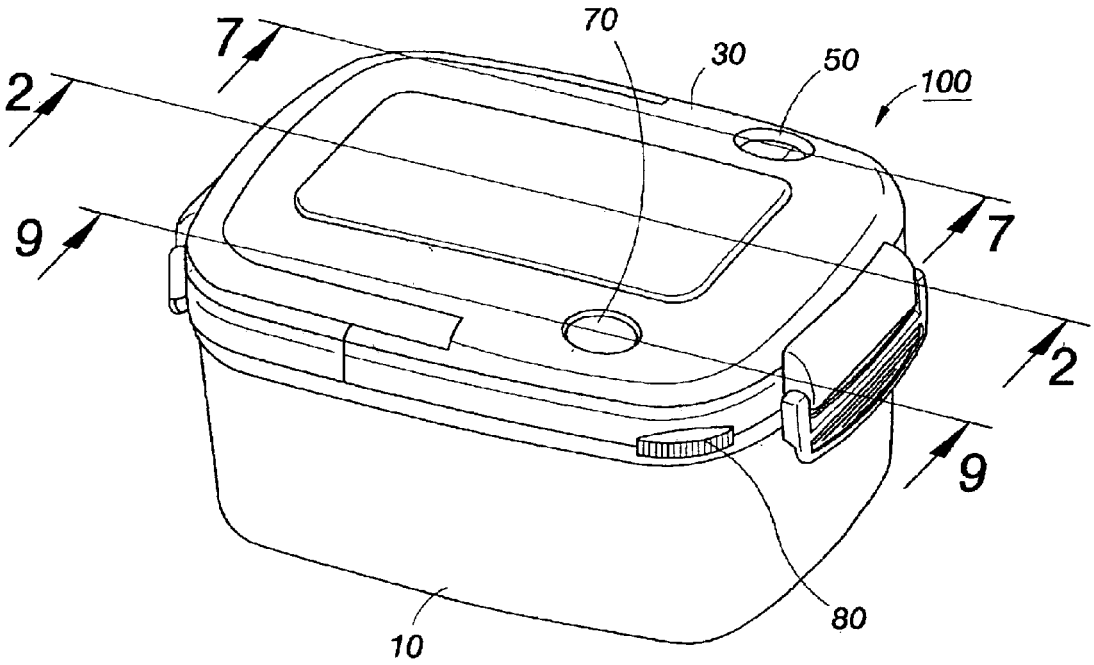
FIG. 1 is a perspective view of the present invention.
Figure 2:
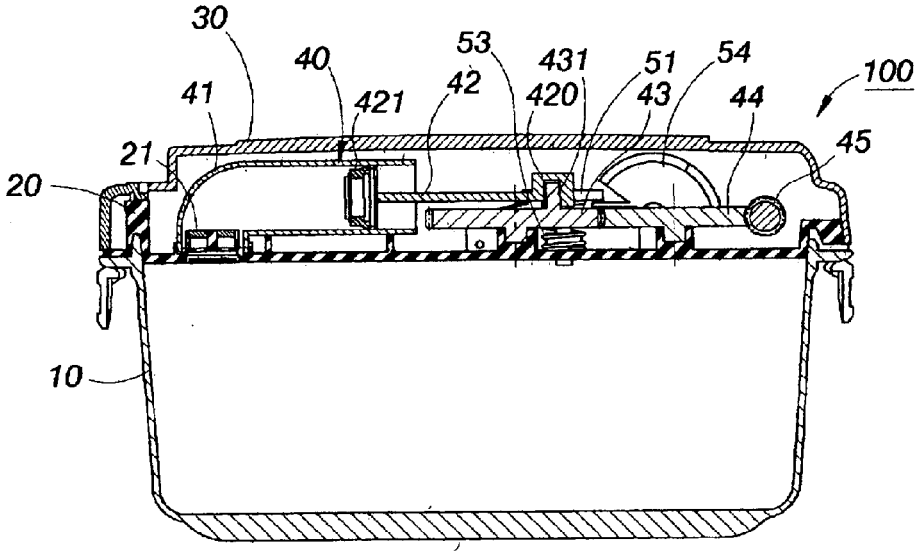
FIG. 2 is a cross section view along line 2—2 of FIG. 1.

Referring to FIG. 1, the vacuum box of the present invention is illustrated. FIG. 2 is a schematic view along line

Figure 4:
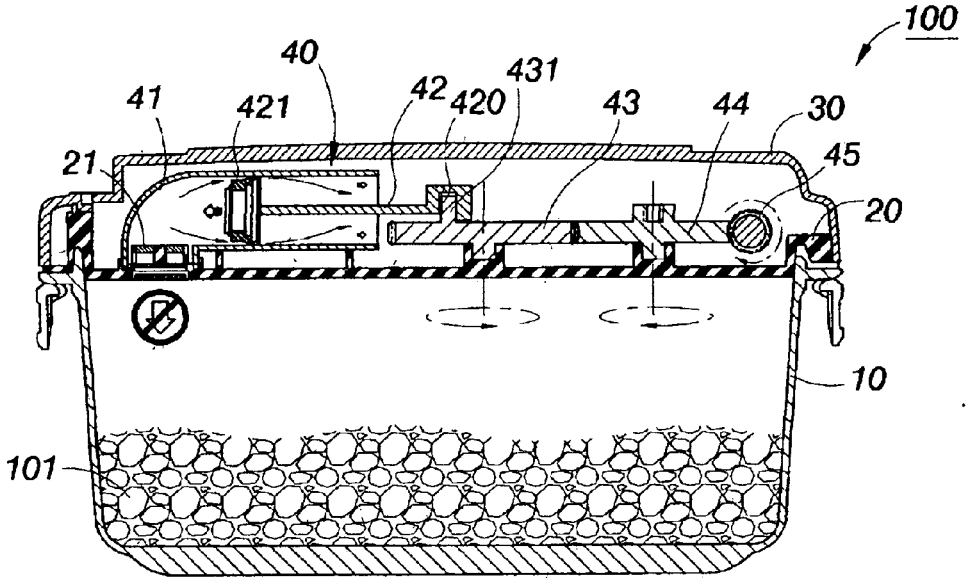
FIGS. 4 and 5 are schematic view showing the electromotive pumping in the present invention.
Figure 9:
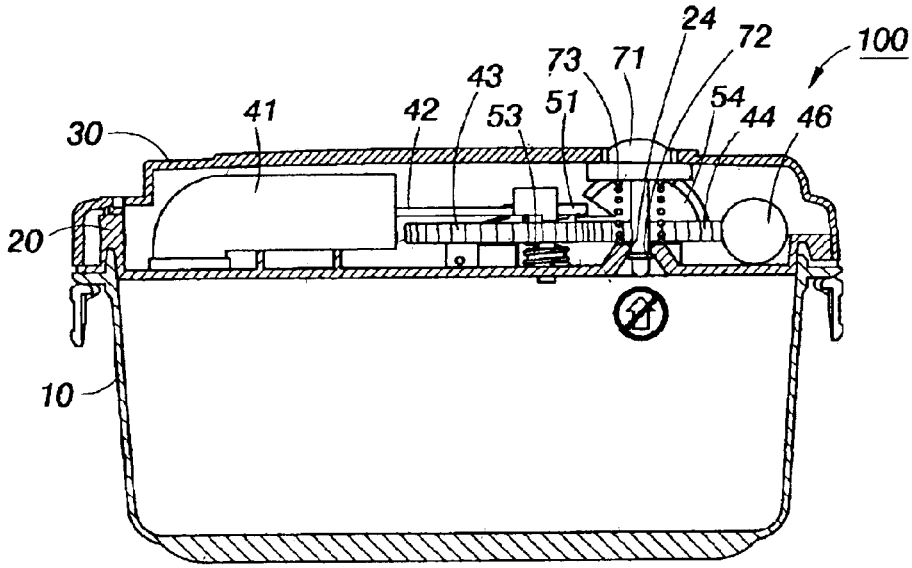
FIG. 9 is a cross section view along line 9—9 of FIG. 1.

2—2 of FIG. 1. In the present invention, the vacuum box includes a lower box 10, an isolating layer 20, an upper cover 30, etc. The isolating layer 20 is at a bottom of the upper cover 30 for sealing the lower box 10. The isolating layer 20 is installed with a check valve 21 and a pressure relief valve 24, as shown in FIGS. 4 and 9.

Figure 3:
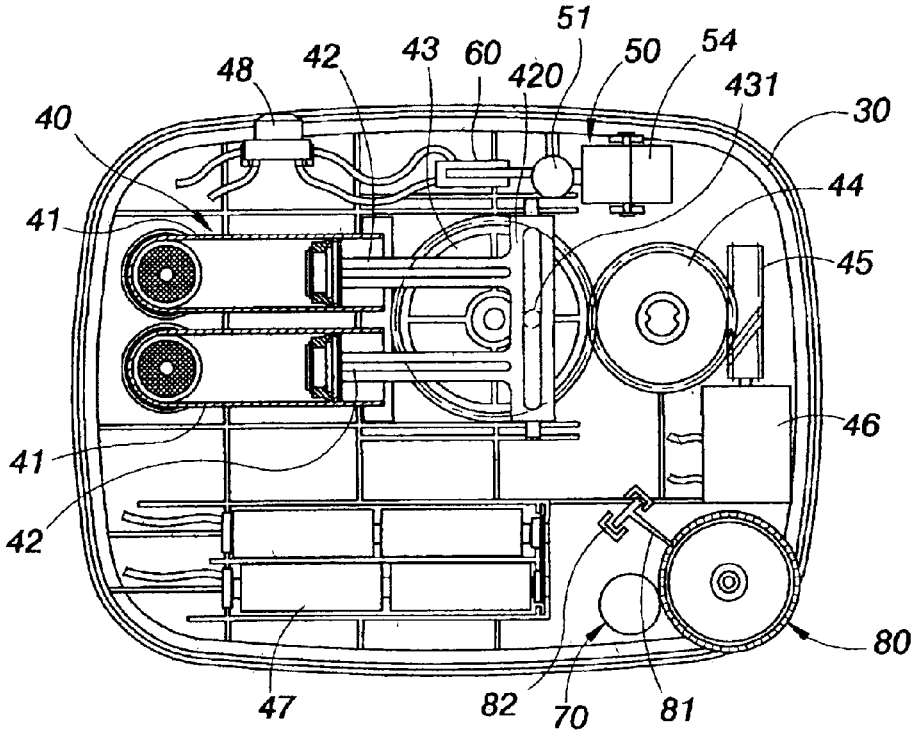
FIG. 3 is an elevational view of the isolating layer of the present invention.

Referring to FIG. 3, the isolating layer 20 is installed with a pump unit 40, a pressure display unit 50, a sensing switch 60, a pressure relief device 70, and a time indicator 80. The pump unit 40 is formed by two pump tubes 41, two unidirectional ventilation studs 42 in the two pump tubes 41, a gear set aside the two studs 42, a motor 46 on the isolating layer 20 for driving the gear set, a battery set 47 on the isolating layer 20 for supplying power to the motor 47, and a control button 48 on the upper cover 30 for controlling the power of the box. The gear set 43 is formed by a driven gear 43, a driving gear 44 engaged to the driven gear 43, and a worm rod 45 engaged to the driving gear 44. The worm rod 46 is driven by the motor 46. Referring to FIG. 4, a lower end of the pump tube 41 is tightly connected to the check valve 21 of the isolating layer 20. When power is conducted, the motor 46 actuates the gear set to rotate and the post 431 of the driving gear 43 rotates. Since the post 431 is confined in a long groove of a crossing rod 420 connected to a rear end of the studs 42, when the post 431 rotates, the crossing rod 420 moves reciprocally. Thereby, the two studs 42 cause the pump tubes 41 to pump air unidirectionally. When the studs 42 moves forwards, air in the pump tubes 41 is sealed by the check valve 21 and thus cannot drain into the lower box 10. Thus air will be vented out from the edges of vent washers 421.

Figure 5:
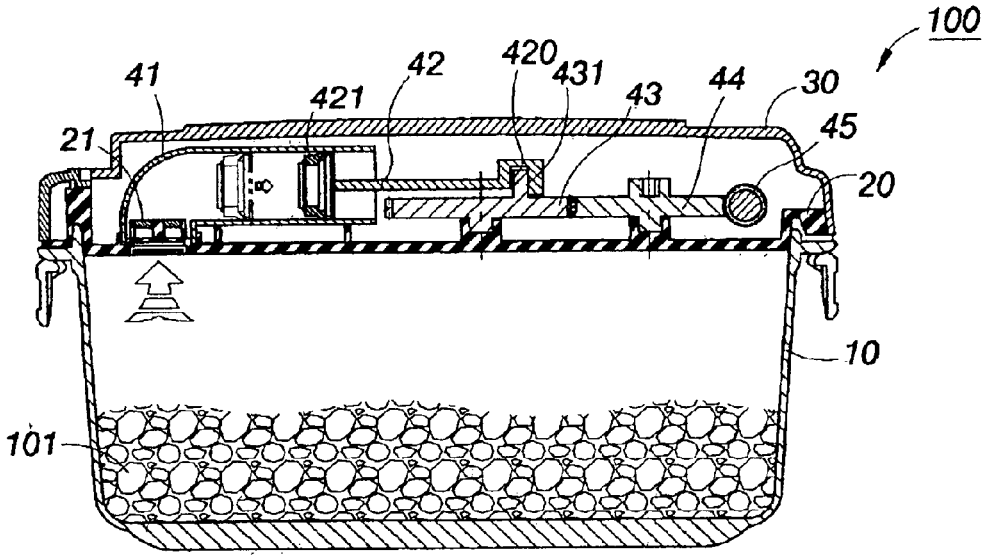

Referring to FIG. 5, when the studs 42 move backward, the washers 421 will tightly seal to the pump tubes 41 and then move backwards so that the air at the back side of the pump tubes 41 are vented out and the pressures in front of the pump tubes 41 are negative. Since at this moment, the pressures of the pump tubes 41 are negative, air in the lower box 10 will be pumped into the pump tubes 41 from the check valve 21, and then by the continuous operation of the motor 46 and the gear set, as shown in FIGS. 4 and 5, air in the lower box 10 can be pumped out rapidly so that object in the lower box 10 can retain in fresh state.

Figure 6:
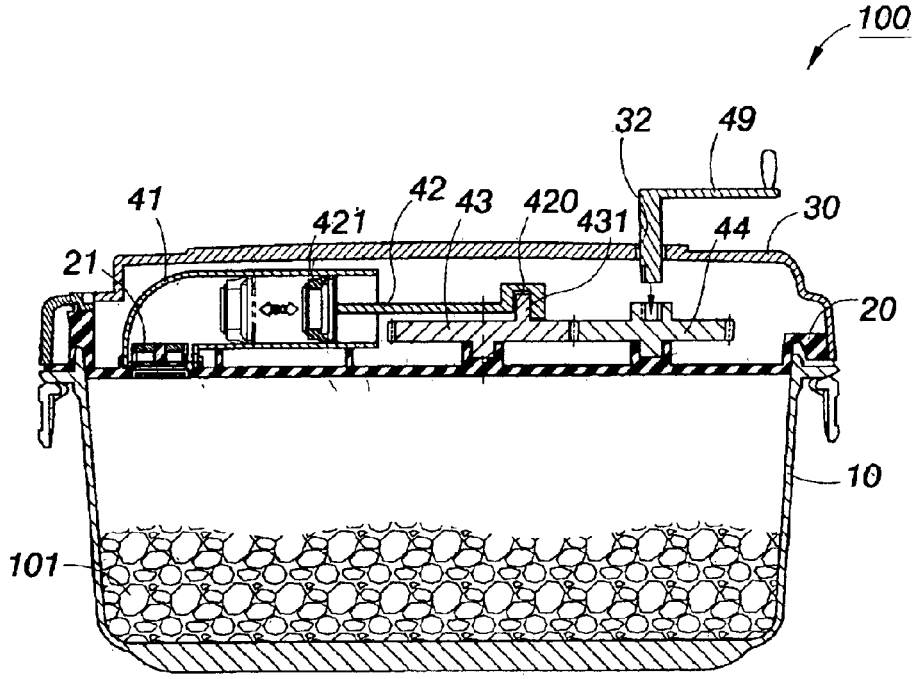
FIG. 6 is a schematic view showing the manual pumping in the present invention.

With reference to FIG. 6, a stick 49 passes through a through hole 32 at the upper cover 30 and then is connected to a shaft of the driving gear 44. By rotating the stick 49, the pump unit 40 pumps air. However this is not the feature of the present invention and thus the details will not be described here. In the present invention, when the motor 46 is not used, the present invention can be operated manually.

Figure 7:
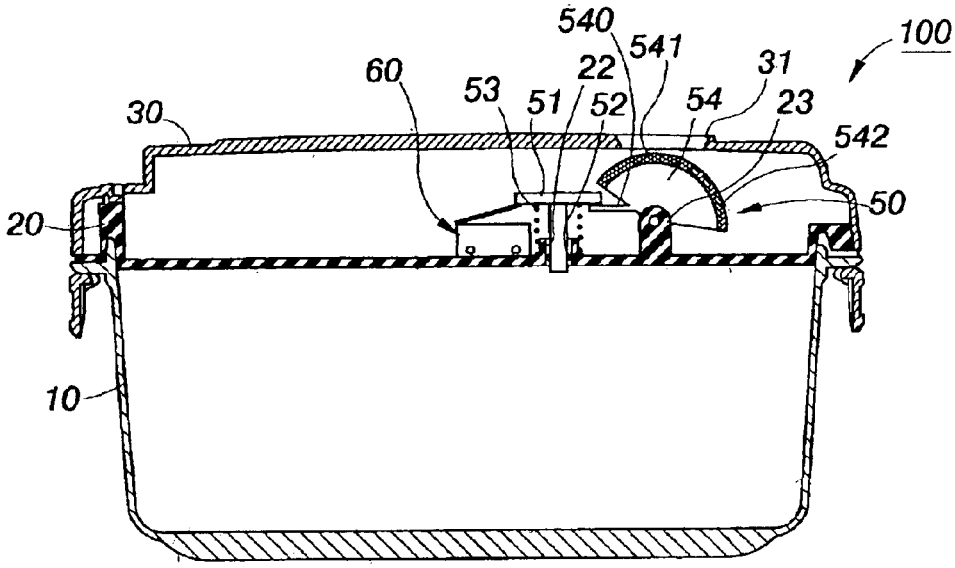
FIG. 7 is a cross section view along line 7—7 of FIG. 1.

Referring to FIG. 7, the pressure display unit 50 is installed in the isolating layer 20. The isolating layer 20 is formed by a pressure button 51, an airtight ring 52, a spring 53, and a display mask 54. A lateral side of the pressure mask 51 has a T shape and is slidably installed in a pressure hole 22 of the isolating layer 20 by an airtight ring 52 (for example, an O ring). The spring 53 resists against a lower edge of the pressure button 51 and an outer edge of the pressure hole 22. A lower end of the display mask 54 is pivotally connected to an ear 23. One side of the display mask 54 is extended with a post 540 which is connected to the pressure button 51. Besides, the display mask 54 is a sector transparent cover and a top thereof has two color indicators 541 and 542 of different colors (for example, rod color and blue color). Moreover, pressure scales can be formed thereon.

Figure 8:
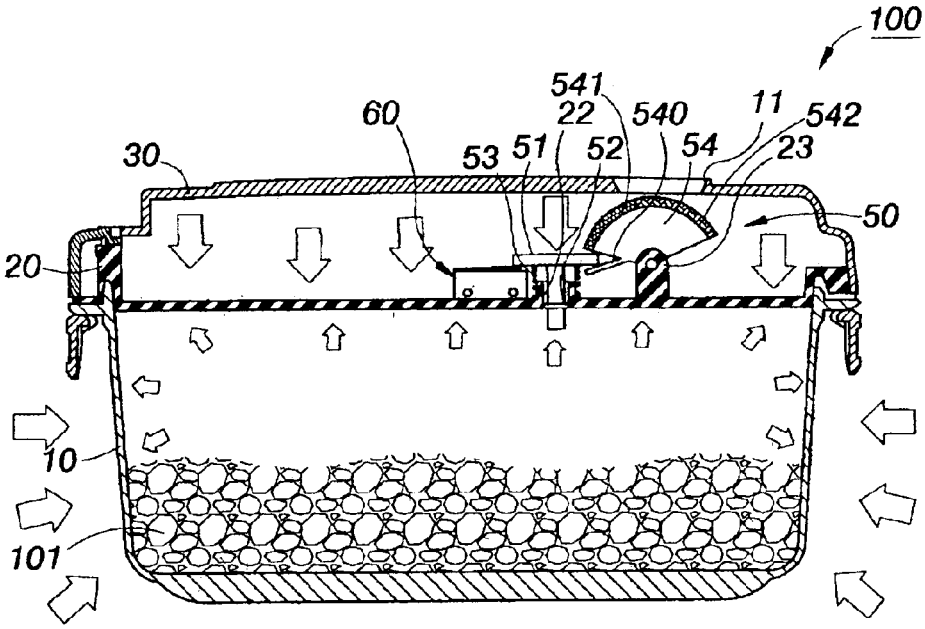
FIG. 8 is a schematic view showing the pressure indicator of the vacuum box of the present invention.

When the pressure of the lower box 10 reduces, the pressure button 51 will sink downwards due to the absorption of negative pressure. At this time when the post 540 is pressed downwards, the display mask 54 rotates, as shown in FIG. 8. Then the color indicators 541 and 542 of the display mask 54 rotate so that the display color is red instead of the original blue color (red color represents a normal pressure and blue color represents negative pressure). The user can view the color from a viewing hole 31 in the upper cover 30 so as to know the pressure of the lower box 10. Furthermore, the sensing switch 60 is installed at a lower lateral side of the pressure button 51. When the control button 48 of the upper cover 30 is pressed (ON), the circuit in the lower box 10 is conductive. If the lower box 10 is in normal pressure, the motor 46 will actuate immediately so that the pump unit 40 pumps air. Therefore the negative pressure of the lower box 10 increases gradually and the pressure button sinks until the sensing switch 60 is touched, Then the sensing switch 60 will interrupt the operation of the motor 46. At this time, the lower box 10 is vacuumed so as to prevent the motor 46 from idly rotation or prevent a large pressure difference between the outer side and inner side of the lower box 10 so that the lower box 10 deforms.

Since the control button 48 is pressed (ON), the lower box 10 is retained in conduction, while after long using time, the vacuum lower box 100 of the present invention will lose of pressure. Then the negative pressure in the lower box 10 will reduce so that the pressure button 51 will restore due to the resilient force of the spring 53. The sending sheet of the sensing switch 60 will resilient and the display mask 54 will rotate reversely. The color indicator is changed to red color indicator 541 from the blue color indicator 542 until the pressure button 51 rises to the top and the display mask 54 will rotate to an extreme. This is shown that the pressure in the lower box 10 is approach to a normal pressure (i.e., the negative pressure is very small or is zero). At this time, since the sensing sheet of the sensing switch 60 has risen to the top, the motor 46 will be actuated so that the pump tubes 41 pump air until the lower box 10 is vacuumed. Then the motor 46 is stopped. Therefore, the lower box 10 is in negative pressure to avoid to lose of pressure to deteriorate the objects in the box. When the control button 48 is at in off state, no electric power is conducted to the box 10 and thus the lower box 10 lose of pressure. The motor 46 can be actuated by the sensing switch 60. However only the control button 48 is at ON state, the sensing switch 60 will actuate the motor 46.

Referring to FIG. 9, the pressure relief device 70 is formed by a pressure relief button 71, an airtight ring 72, and a spring 73. The air tight ring 72 encloses a lower edge of the pressure relief button 71. An upper edge of the airtight ring 72 resists against the opening of the pressure relief hole 24 of the isolating layer 20. The spring 73 resists against the opening of the pressure relief hole 24 and the pressure relief button 71. A top of the pressure relief button 71 exposes from the top of the upper cover 30 so that an operator can manually operated the button.

Figure 10:
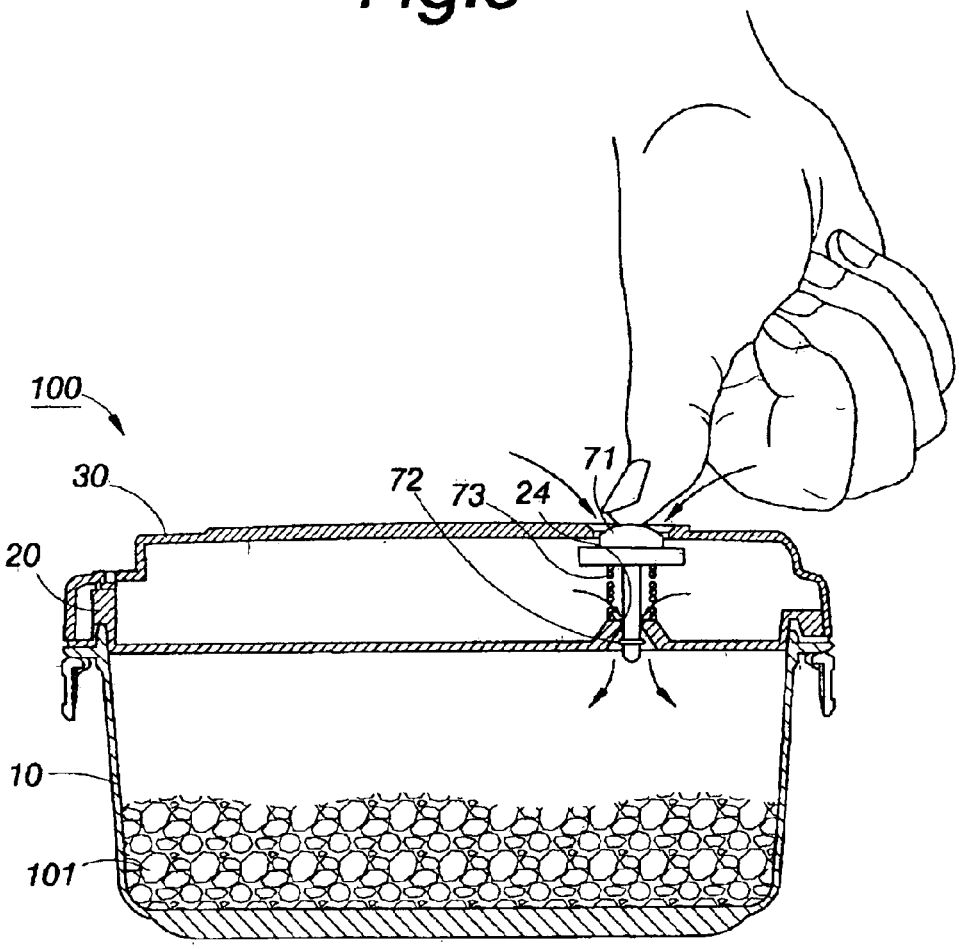
FIG. 10 is a schematic view showing the pressure relief of the vacuum box of the present invention.

With reference to FIG. 10, when the pressure relief button 71 is pressed, the airtight ring 72 will separate from the pressure relief hole 24 so that air can flow into the box 10 of the pressure relief button 24. As a result, the external and internal pressures are balanced so that the negative pressure in the box 10 is released. Then the isolating layer 20 combined to the upper cover 30 can not separates from the box 10.

Besides, referring to FIGS. 1 and 3, the corners of the upper cover 30 and isolating layer 20 are formed with a rotational time indicator 80 (being a round button). Only a part of the time, indicator 80 protrudes out of the edge of the upper cover 30. The exposed portion of the time indicator 80 indicates time and date. When a plurality of vacuum boxes are placed one over another. The time indicators are used to indicate time. Moreover, a T shape elastic positioning sheet 81 is fixed to the groove 82 of the isolating layer 20. The positioning sheet 81 has a front post which is inserted into the ratchet of the indicator so as to fix the indication of the time indicator.

Figure 11:
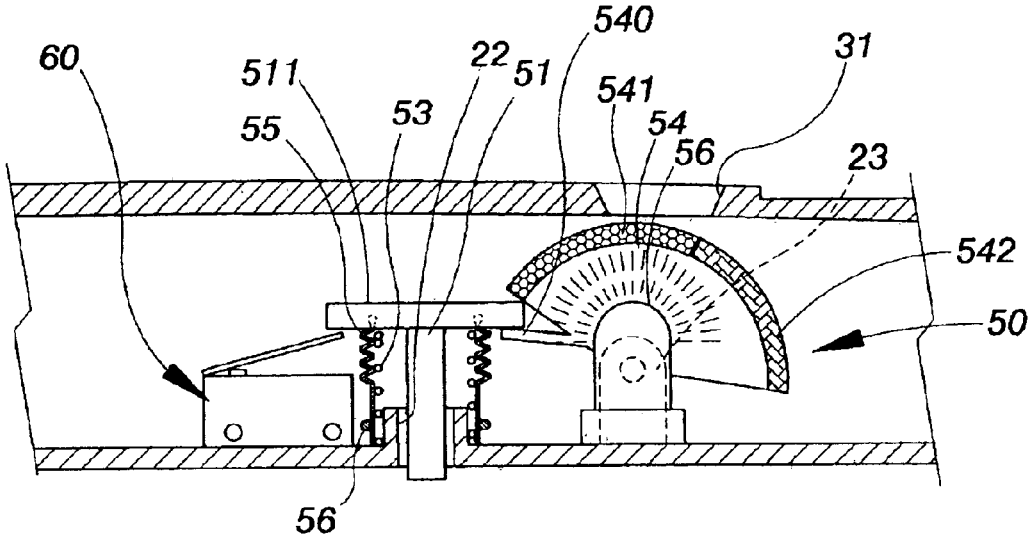
FIG. 11 is a cress section view showing that the pressure indicator of the present invention shows a normal pressure.
Figure 12:
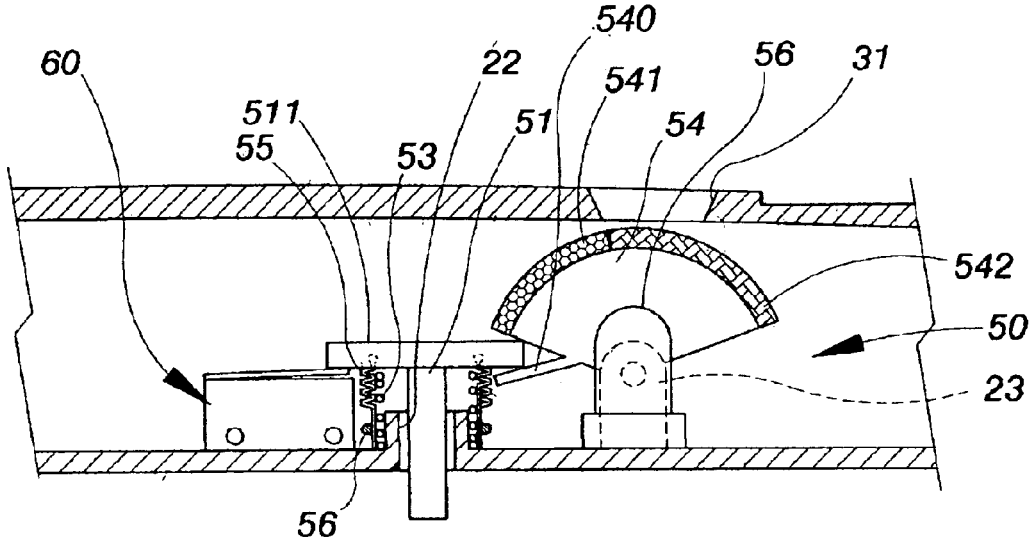
FIG. 12 is a cross section view showing that the pressure indicator of the present invention shows a negative pressure.

Referring to FIG. 11, another structure of the pressure indicator 50 according to the present invention is illustrated. The difference of this example different from the previous one is that an airbag 55 encloses a pressure button 51 and a spring 53. The airbag 55 is a rubber snake-like tube. A top thereof is tightly connected below the top cover 511 of the pressure button 51. A lower end thereof surrounds the periphery of the pressure hole 22 and are tightened by an elastic ring 56. Thereby, the airbag 55 is tightly sealed and is positioned firmly. The use of the spring 53 is to cause that the airbag 55 can rise rapidly. Since no air tight ring 52 in the pressure hole 22, the airbag 55 will rise and descend due to the negative pressure of the box 10. When the pressure of the box 10 is negative, the airbag 55 descends wit the pressure button 51, as shown in FIG. 12. On the contrary, when the box 10 is in normal pressure, the airbag 55 rises with the pressure button 51, as shown in FIG. 11.

Furthermore, to see the color indicator, LEDs 56 can be installed to the display mask 54. When the LEDs are arranged below the display mask 54, two ears 23 are necessary, which are arranged at two sides. Furthermore, the LEDs lights up, when the box 10 is in normal pressure. In vacuum, the sensing switch 60 interrupts and no light is emitted.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A vacuum box comprising:

a lower box;

an upper cover;

an isolating layer installed on a top of the upper cover for sealing a seal layer on the lower box; the isolating layer having a check valve and a pressure relief valve;

a pump unit installed on the isolating layer; the pump unit including two pump tubes connected to the isolating layer through the check valve; each pump tube having a stud; and a gear set connected to the studs;

a motor installed on the isolating layer for driving the motor;

a battery set installed on the isolating layer for supplying power to the motor;

a control button installed on the upper cover for opening or closing a power to the box;

wherein the isolating layer is installed with a pressure display unit; the pressure display unit is formed by a pressure button installed in a pressure hole of the isolating layer by an airtight ring, a spring below the pressure button; a sealed airbag installed at a top cover of the pressure button and a periphery of the spring; and a display mask connected to the pressure button; the display mask is a sector transparent casing and is pivotally installed to ears of the isolating layer; a top of the display mask is mounted with at least two color indicators; a lower lateral side of the pressure button is installed with a sensing switch which sense the rising or descending of the pressure button.

2. The vacuum box as claimed in claim 1, wherein the isolating layer has a pressure relief device; the pressure relief device is formed by a pressure relief button, a spring resisting against the opening of the pressure relief hole and the pressure relief button; a top of the pressure relief button exposes from the top of the upper cover.

3. The vacuum box as claimed in claim 1, wherein one side of the display mask is extended with a post which is connected to the pressure button; and the display mask exposes from a viewing hole of the upper cover.

4. The vacuum box as claimed in claim 1, wherein the corners of the upper cover and isolating layer are formed with a rotational time indicator; the time indicator indicates time and date.

5. The vacuum box as claimed in claim 1, wherein the LEDs are installed to the display mask.

6. The vacuum box comprising:

a lower box;

an upper cover;

an isolating layer installed on a top of the upper cover for sealing a seal layer on the lower box; the isolating layer having a check valve and a pressure relief valve;

a pump unit; the pump unit including two pump tubes connected to the isolating layer by check valves; each pump tube having a stud; and a gear set connected to the studs;

a motor installed on the isolating layer for driving the motor;

a battery set installed on the isolating layer for supplying power to the motor;

a control button installed on the upper cover for opening or closing a power to the box;

wherein the isolating layer is installed with a pressure display unit; the pressure display unit is formed by an airtight ring in a pressure hole of the isolating layer; a pressure button installed in a pressure hole of the isolating layer by an airtight ring, a spring is below and resists against a top cover of the pressure button; and a display mask connected to the pressure button; the display mask is a sector transparent casing and is pivotally installed to ears of the isolating layer; a top of the display mask is mounted with at least two color indicators; a lower side of the pressure button is installed with a sensing switch which sense the rising or descending of the pressure button.

7. The vacuum box as claimed in claim 6, wherein the isolating layer has a pressure relief device; the pressure relief device is formed by a pressure relief button, a spring resisting against the opening of the pressure relief hole and the pressure relief button; a top of the pressure relief button exposes from the top of the upper cover.

8. The vacuum box as claimed in claim 6, wherein one side of the display mask is extended with a post which is connected to the pressure button; and the display mask exposes from a viewing hole of the upper cover.

9. The vacuum box as claimed in claim 6, wherein the corners of the upper cover and isolating layer are formed with a rotational time indicator; the time indicator indicates time and date.

10. The vacuum box as claimed in claim 6, wherein the LEDs are installed to the display mask.

* * * * *